US012270133B1

(12) United States Patent
Clarke et al.

(10) Patent No.: US 12,270,133 B1
(45) Date of Patent: Apr. 8, 2025

(54) NEEDLING SYSTEM FOR PRODUCING A TEXTILE PREFORM

(71) Applicant: ARIANEGROUP SAS, Les Mureaux (FR)

(72) Inventors: Gareth Clarke, Le Haillan (FR); Julien Bardy, Le Haillan (FR); Franck Laffargue, Le Haillan (FR); Nicolas Maisonnave, Le Haillan (FR); David Bitonneau, Le Haillan (FR); Jean-Marc Dupillier, Le Haillan (FR)

(73) Assignee: ARIANEGROUP SAS

( * ) Notice: Subject to any disclaimer, the term of this patent is extended or adjusted under 35 U.S.C. 154(b) by 0 days.

(21) Appl. No.: 18/846,972

(22) PCT Filed: Mar. 8, 2023

(86) PCT No.: PCT/FR2023/050307

§ 371 (c)(1),
(2) Date: Sep. 13, 2024

(87) PCT Pub. No.: WO2023/175255

PCT Pub. Date: Sep. 21, 2023

(30) Foreign Application Priority Data

Mar. 14, 2022 (FR) ..... 2202206
Mar. 14, 2022 (FR) ..... 2202207

(51) Int. Cl.
*D04H 18/02* (2012.01)
*D04H 1/46* (2012.01)

(52) U.S. Cl.
CPC ..... *D04H 18/02* (2013.01); *D04H 1/46* (2013.01); *D10B 2505/02* (2013.01)

(58) Field of Classification Search
CPC ..... D04H 18/00; D04H 18/02; D04H 1/46
See application file for complete search history.

(56) References Cited

U.S. PATENT DOCUMENTS 5,093,059 A * 3/1992 Nathoo ..... B05B 7/1486 264/517
5,226,217 A * 7/1993 Olry ..... D04H 18/02 28/107

(Continued)

FOREIGN PATENT DOCUMENTS

CN 105755680 B 10/2017
CN 110109421 A 8/2019

(Continued)

OTHER PUBLICATIONS

International Search Report as issued in International Patent Application No. PCT/FR2023/050307, dated May 25, 2023.

(Continued)

*Primary Examiner* — Jillian K Pierorazio
(74) *Attorney, Agent, or Firm* — Pillsbury Winthrop Shaw Pittman LLP

(57) ABSTRACT

A needling system for making a textile preform includes a needling head; a robotic arm movable in several degrees of freedom, carrying the needling head and configured so as to move the needling head following predetermined trajectories and orientations; a textile strip feeding device mounted on the needling head and configured to deposit the textile strip on a support and cut it, and a monitoring unit configured to control the robotic arm, the actuation of the needling head and the deposition of the textile strip according to a predefined program for making the textile preform.

9 Claims, 6 Drawing Sheets

(56) References Cited

U.S. PATENT DOCUMENTS 5,991,987 A * 11/1999 Olry ..... B29B 11/16
28/142
2024/0141571 A1* 5/2024 Pujar ..... B25J 15/0071

FOREIGN PATENT DOCUMENTS

CN 112318499 A 2/2021
FR 2 669 941 A1 6/1992

OTHER PUBLICATIONS

Written Opinion of the International Searching Authority as issued in International Patent Application No. PCT/FR2023/050307, dated May 25, 2023.
Chen, X., et al., "Robot needle-punching path planning for complex surface preforms," Robotics and Computer Integrated Manufacturing., vol. 52, Aug. 2018, pp. 24-34, XP055975165.

* cited by examiner

[Fig. 1]
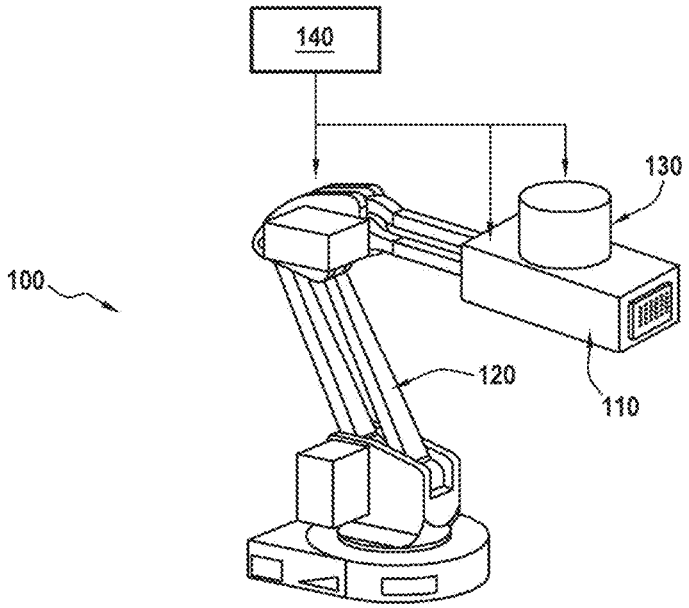
[Fig. 2]
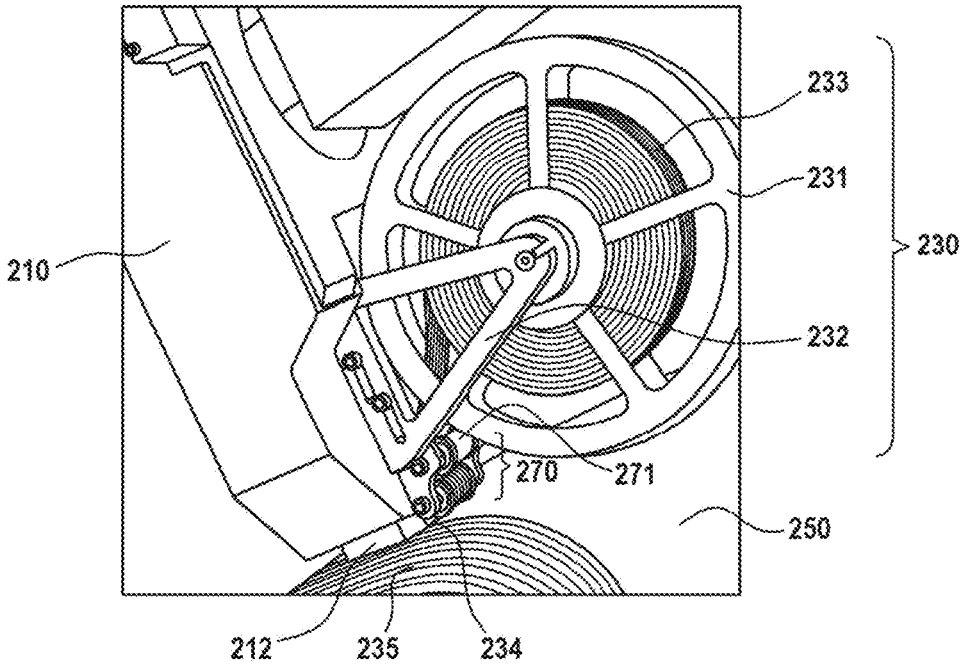

[Fig. 3]
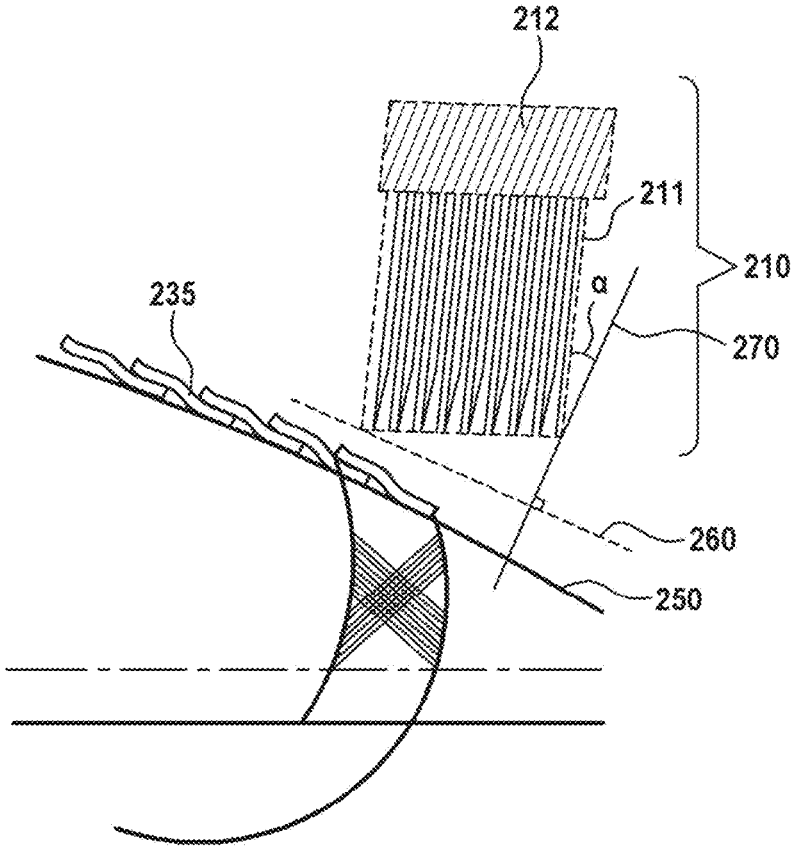

[Fig. 4]
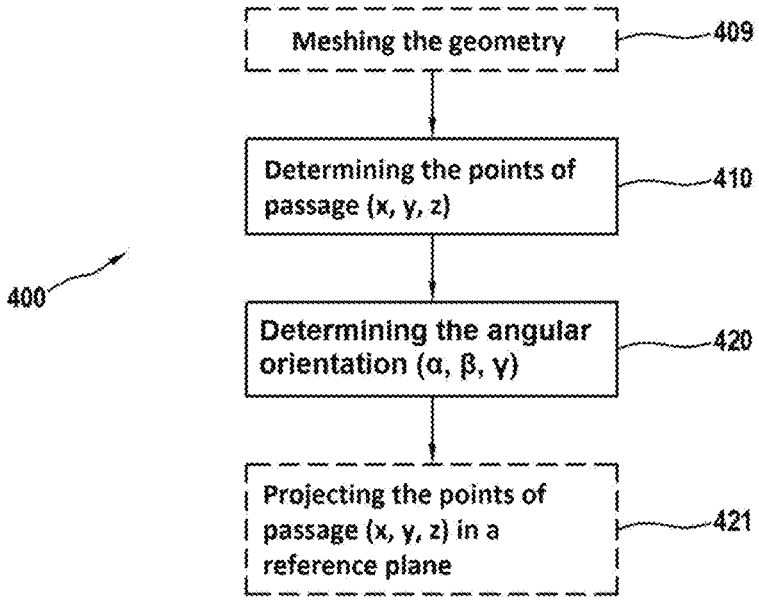
[Fig. 5A]
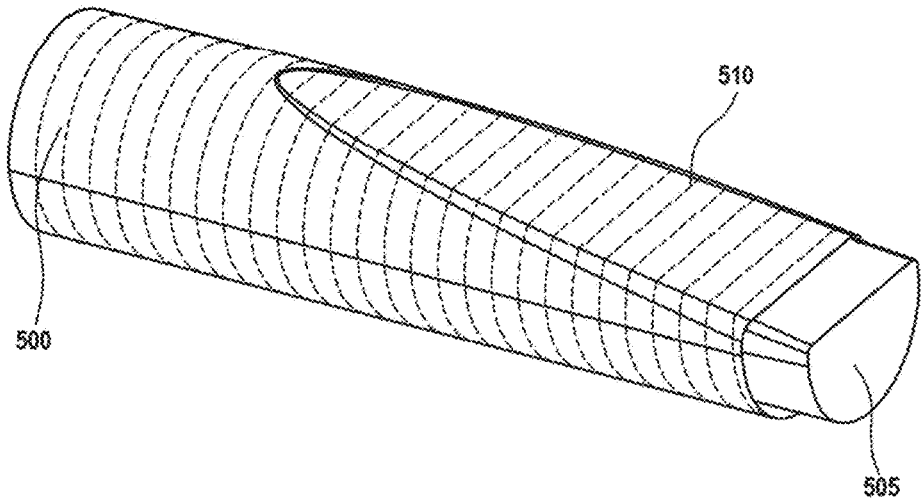

[Fig. 5B]
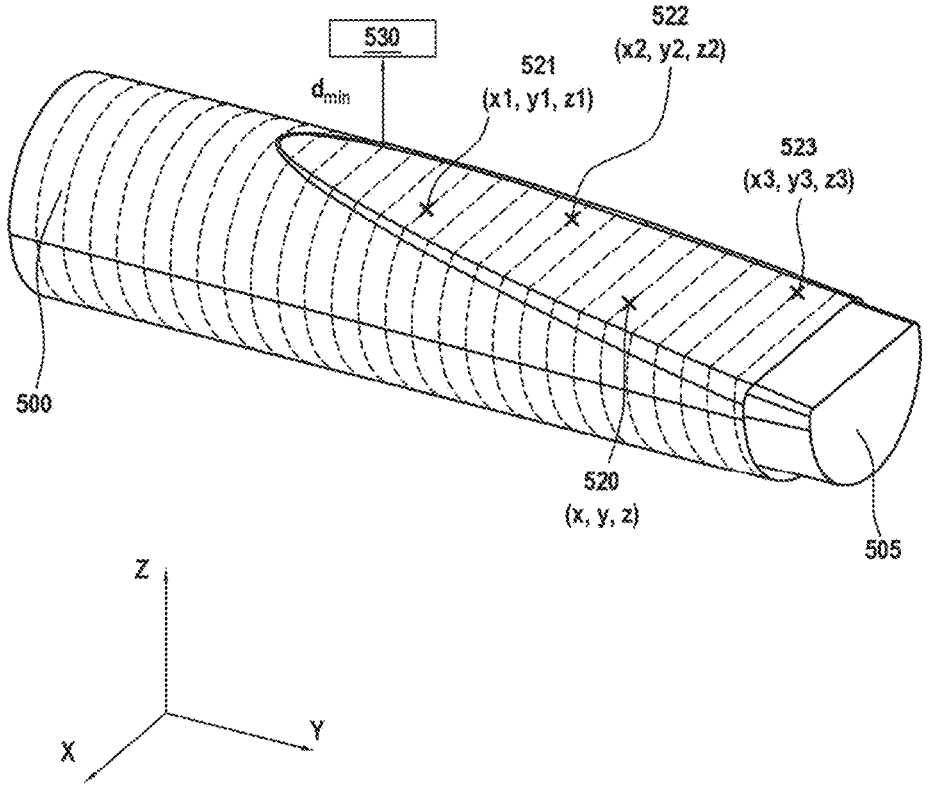

[Fig. 5C]
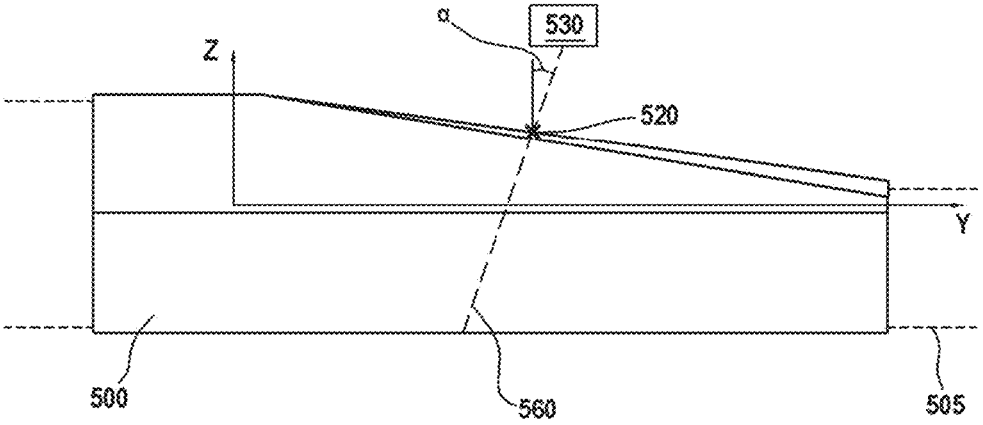
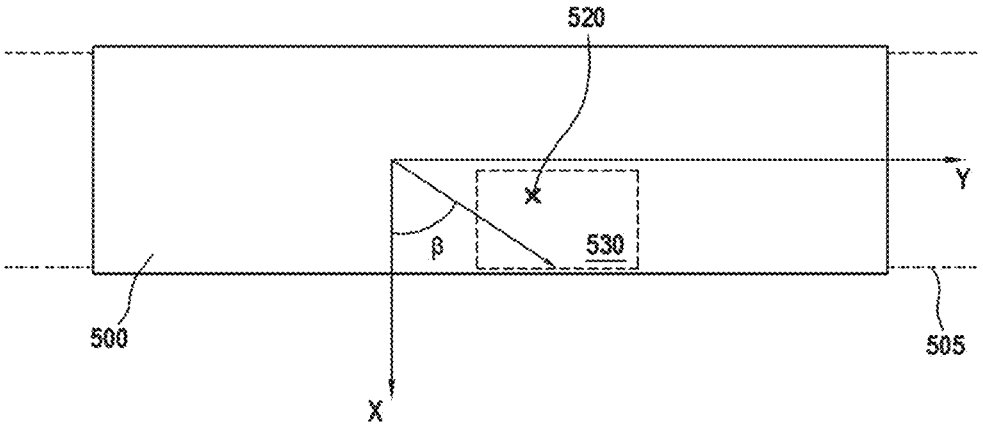

[Fig. 5D]
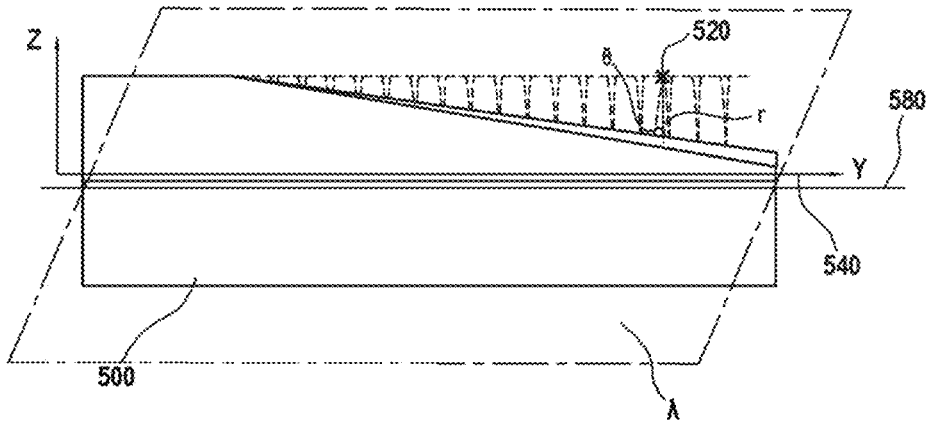
[Fig. 6]
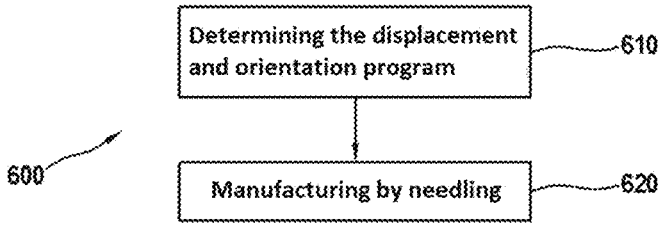

NEEDLING SYSTEM FOR PRODUCING A TEXTILE PREFORM

CROSS-REFERENCE TO RELATED APPLICATIONS

This application is the U.S. National Stage of PCT/FR2023/050307, filed Mar. 8, 2023, which in turn claims priority to French patent application number 22 02206 filed Mar. 14, 2022 and French patent application number 22 02207 filed Mar. 14, 2022. The content of these applications are incorporated herein by reference in their entireties.

TECHNICAL FIELD

The present invention relates to the manufacture of a textile preform by needling, and more particularly a needling system for the manufacture of a textile preform.

PRIOR ART

The textile preforms form the reinforcement of organic or ceramic matrix composite materials. They form a framework for the material taking up most of the mechanical forces, which is reinforced and protected by the organic or ceramic matrix of the composite material.

Making textile preforms by needling consists in superimposing textile plies and linking these plies together by needling. Particularly, the needling consists in linking together the plies by transferring fibers from one ply to another in the Z direction that is to say along the thickness of the preform, thus creating mechanical connections between the plies in this direction. The current needling systems thus allow making axisymmetric preforms or preforms whose geometry is a through geometry.

The current needling means are programmed to follow a certain trajectory so as to needle the preform according to some criteria, such as for example the density of Z fibers. The current programs are specific to the machine used, and cannot be used on another one. In addition, they can follow an axisymmetric profile based on an adaptive mode, which allows correcting the position of the machine as a function of the extra thicknesses encountered during the needling.

However, some preforms, such as atmospheric re-entry thermal protection preforms, can have a spherical cap shape (non-through geometry) or a non-axisymmetric geometry and the current needling means are not adapted to this type of geometry.

It is therefore desirable to have a new, more versatile needling system that allows needling preforms whose geometry is a non-axisymmetric and/or non-through geometry, or whose geometry is an axisymmetric or non-axisymmetric geometry, a through or non-through geometry, and capable of needling textile strips whose trajectories are fully parameterizable, without trajectory limitation.

It is also desirable to have a new solution for programming the needling means that can be used on several needling machines and adapt to any type of preform geometry, including the non-axisymmetric and non-through geometries.

DISCLOSURE OF THE INVENTION

The present invention relates to a needling system for making a textile preform comprising:

a needling head;

a robotic arm movable in several degrees of freedom, carrying the needling head and configured so as to move the needling head following predetermined trajectories and orientations;

a textile strip feeding device mounted on the needling head and configured to deposit the textile strip on a support and cut it, and a monitoring unit configured to control the robotic arm, the actuation of the needling head and the deposition of the textile strip according to a predefined program for making the textile preform.

The invention thus proposes a modular needling head because, thanks to the robotic arm, it can adapt to the complex preform geometries. The needling system of the invention therefore makes it possible to manufacture preforms with a non-through geometry, such as a spherical cap, or non-axisymmetric geometries. The needling system of the invention also makes it possible to parameterize custom textile strip trajectories, without trajectory limitation.

In addition, the presence of the textile strip feeding device on the needling head makes it possible to envisage a deposition of a strip and its needling on the strips previously deposited simultaneously with a single system. This makes it possible to deposit the textile strips in various directions in thin or thick thickness, and also to automate the placement of the strips thanks to the robotic arm and to the monitoring unit. This also makes it possible to do without a fixing additive between the strips or other elements that could pollute the strips forming the preform and that could disrupt the fibers/matrices connections during densification of the needled preform, because the strips are held together during the needling by the partial transfer in the transverse direction of the fibers coming from the deposited strips. In other words, in the case of the invention, it is a mechanical bonding of the textile strips and not a chemical one, unlike the methods of the prior art making it possible to deposit and hold the textile strips and/or the yarns (such as Automatic Tape Laying ATL and Automatic Fiber Placement AFP technologies).

According to one particular characteristic of the invention, the textile strip feeding device comprises a regulation system, for example a braking system, configured to adjust the tension of the textile strip when it is deposited on the support as a function of a given instruction, or as a function of one particular point of the trajectory.

According to another particular characteristic of the invention, the textile strip feeding device comprises a system for guiding the textile strip.

According to another particular characteristic of the invention, the textile strip guiding system comprises diverting rollers adjustable according to at least one spherical three-dimensional reference frame.

According to another particular characteristic of the invention, the textile strip feeding device comprises a regulation system in lateral position.

This makes the guiding of the strip and its placement on the support more accurate. This can particularly be useful in the case where a spooling is carried out, as illustrated in FIG. 3, by allowing a slight translation of the strip to correct a possible mispositioning during the deposition.

Another object of the invention relates to a method for manufacturing a textile preform by needling implemented by the needling system of the invention on a support tooling whose shape corresponds to that of the textile preform to be made, the method comprising the deposition and the needling of a textile strip on the support tooling.

This method allows directly needling the textile strip to the shape of the final preform.

According to one particular characteristic of the invention, the support tooling has a non-axisymmetric and/or non-through shape.

This allows making preforms with complex geometry.

According to another particular characteristic of the invention, the textile strip is deposited and needled on the support tooling without trajectory limitation.

According to another particular characteristic of the invention, the needling head forms an angle comprised between −85° and 85° relative to the direction perpendicular to the tangent plane of the support tooling during all or part of the deposition and of the needling of the textile strip.

This makes it possible to transfer the fibers, during the needling, in a direction perpendicular or not perpendicular to the tangent of the preform that is to say the tangent of the support tooling. The fact of not being limited to a perpendicular direction makes it possible to transfer the fibers in numerous directions to optimize the thermomechanical properties and the abrasion resistance of the final textile preform according to the applications targeted for the part comprising this preform.

The present invention also relates to a method for determining a program of displacement and orientation of a needling head for making a textile preform by needling a textile strip on a support tooling, comprising at least:

determining a set of triplets of coordinates (x, y, z) of the points of passage of the needling head as a function of the positions of the fibers in the textile preform to be made, of its local geometry and of a predetermined minimum distance to be met between the needling head and the support tooling or the preform making it possible to avoid a collision with the latter, and determining the angular orientation of the needling head (α, β, γ) for each point of passage as a function of the angular orientation of the textile strip and of the fibers in the textile preform to be made.

Thanks to the method of the invention, the points of passage and the orientation of the needling head are determined before starting the needling by taking into account the complexity of the geometry of the preform to be made, the density and the orientation of the Z fibers while ensuring that the support tooling and the preform do not collide with the needling head. This program is therefore not linked to a particular machine and can be adapted to all machines and desired preform shapes. It thus makes it possible to versatilely manufacture textile preforms by needling according to the needs and the desired thermostructural properties, such as for example the density of Z fibers and the orientation of the Z fibers.

In addition, as the complexity of the geometry of the preform to be made is taken into account, the number of points of passage is adapted to reduce calculation times and the program itself. For example, if an area has a small local radius of curvature, the number of points of passage will be greater in this area than another area with a larger radius of curvature.

The determination of the triplets of coordinates of the points of passage of the needling head and of the angular orientation of the head can result from one or several calculations, or some parameters (coordinate or angle) can be predefined in advance.

The determination of the triplets of coordinates of the points of passage of the needling head can also be carried out as a function of the width of the textile strip and its possible overlap.

The determination of the angular orientation of the needling head can be carried out relative to the normal to the local geometry.

According to one particular characteristic of the invention, the support tooling is rotating about an axis of rotation and the method comprises a mathematical projection of the points of passage determined in a reference plane fixed or movable relative to the support tooling and comprising the axis of rotation of the support tooling.

This makes it possible to convert the coordinate triplets (x, y, z) into polar coordinates (r, θ, z) and therefore to more easily implement the coordinates of the points of passage of the needling head in the needling machine.

According to another particular characteristic of the invention, the method further comprises determining a local speed of displacement of the needling head as a function of the content of Z fibers in the associated area of the preform to be made and of a rotation of the support tooling.

This makes it possible to adapt the needling density as a function of the geometry of the preform, and thus increase, decrease or keep this density constant according to the local geometric characteristics of the preform.

According to another particular characteristic of the invention, the method further comprises making a mesh of the geometry of the textile preform to be made, the determination of all the triplets of coordinates (x, y, z) being performed on this mesh.

The mesh allows a more accurate mathematical use of the geometry of the preform to then be able to apply all the operations of determining the points of passage and the angular orientation of the head, but also to discretize the number of points of passage as a function of the geometric complexity of the preform to be made.

According to another particular characteristic of the invention, the support tooling has a non-axisymmetric and/or non-through shape.

This allows making a textile preform with complex geometry.

Another object of the invention is a method for manufacturing a textile preform by needling comprising determining a program of displacement and orientation of a needling head according to the invention and manufacturing by needling the textile preform on a support tooling, whose shape corresponds to that of the textile preform to be made, using a needling head programmed according to the determined program.

BRIEF DESCRIPTION OF THE DRAWINGS

Other characteristics and advantages of the present invention will emerge from the description given below, with reference to the appended drawings which illustrate exemplary embodiments without any limitation.

FIG. 1 represents, schematically and partially, a needling system according to one embodiment of the invention.

FIG. 2 represents, partially, a needling head being deposited and needled according to one embodiment of the invention.

FIG. 3 represents, schematically and partially, the needling head of FIG. 2, particularly the orientation of the needles relative to the deposited strip.

FIG. 4 represents a flowchart of the method for determining a program of displacement and orientation of a needling head according to one embodiment of the invention.

FIG. 5A represents, schematically and partially, the step 409 of the method described in FIG. 4.

FIG. 5B represents, schematically and partially, the step 410 of the method described in FIG. 4.

FIG. 5C represents, schematically and partially, the step 420 of the method described in FIG. 4.

FIG. 5D represents, schematically and partially, the step 421 of the method described in FIG. 4.

FIG. 6 represents a flowchart of the method for manufacturing a textile preform by needling according to one embodiment of the invention.

DESCRIPTION OF THE EMBODIMENTS

FIG. 1 represents, schematically and partially, a needling system 100 according to one embodiment of the invention for making a textile preform.

The system 100 comprises a needling head 110 on which are mounted a textile strip feeding device 130, a robotic arm 120 movable in several degrees of freedom and carrying the needling head 110 and a monitoring unit 140.

The robotic arm 120 is configured to move the needling head 110 following the predetermined trajectories and orientations.

The feeding device 130 is configured to deposit the textile strip on a support and cut the deposited strip.

The monitoring unit 140 is configured to control the robotic arm 120, the actuation of the needling head 110 and the deposition of the textile strip according to a predefined program for making the textile preform.

FIG. 2 represents, partially, a needling head 210 carrying a textile strip 233 feeding device 230 according to one embodiment of the invention during the manufacture of a textile preform, particularly during the deposition and the needling of a textile strip 234 on a support tooling 250. FIG. 3 represents a schematic view of FIG. 2, in particular the orientation of the needles of the needling head relative to the deposited strip, the references used for these two figures representing the same objects.

The textile strip 233 feeding device 230 comprises a cassette support 232 and a cassette 231 containing the textile strip 233 and placed on the cassette support 232. The cassette 231 has a width corresponding substantially to the width of the textile strip 233 wound on the cassette 231.

The textile strip 233 is for example a strip or a sheet of yarns whose properties are useful as a fibrous reinforcement in the preform making up a composite material, for example a yarn or a set of yarns, a fabric, a multidirectional non-woven textile (or Non Crimp Fabric, NCF), a braid, or a non-woven web.

The needling head 210 comprises a plurality of needles 211 mounted on a needle board which make it possible to needle the textile strip 234 which has just been deposited on the support tooling 250. This textile strip 234 is thus needled with the strips 235 previously deposited in order to make the textile preform. In order to obtain the desired geometry, the deposition and the needling takes place on the support tooling 250 which has a shape corresponding to that of the preform to be made. Thus, to make a non-axisymmetric preform, the support tooling 250 has a non-axisymmetric shape. The support tooling 250 can also be movable, for example in rotation about an axis, in order to facilitate the movements of the robotic arm and of the needling head 210.

The needling head 210 also comprises a stripper 212 comprising a plate including a plurality of perforations. The plate has an inner face and an outer face, the outer face being present on the side of the support tooling 250. The needle board is facing the inner face of the stripper and the needles 211 are aligned with the perforations present on the plate of the stripper 212. During the needling of the strip 234, the needles 211 move alternately from a retracted position in which they do not protrude from the outer surface of the plate of the stripper 212 to a deployed position in which they protrude from the outer face of the plate in order to penetrate the textile strip 234. The textile strip 233 feeding device 230 is fixed to the needling head 210 transversely to the perforated plate of the stripper 212 intended to be crossed by the needles 211.

The textile strip 233 feeding device 230 can comprise a textile strip guiding system 270 and/or a braking system which makes it possible to adjust the tension of the strip 234 during its deposition. The guiding system 270 can be fixed on the surface of the stripper 212 or on the needling head 210, ideally as close as possible to the surface of the stripper 210, carrying the feeding device 230.

In addition, the textile strip guiding system can be provided with diverting rollers 271 adjustable according to a three-dimensional reference frame, in particular in a spherical reference frame. These rollers 271 are for example adjustable in translation along the direction of the width of the strip 234 and adjustable in rotation along two axes making it possible to adjust the angle of the strip 234 relative to the support tooling 250. These diverting rollers 271 make it possible to guide the strip 234 from the cassette 231 to the deposition surface of the support tooling 250. The width of these rollers 271 can be adapted to the width of the strip 234.

Whatever the embodiment, the textile strip feeding device can be configured to store a textile strip of a width comprised between 5 mm and 500 mm, preferably between 5 mm and 200 mm.

Whatever the embodiment, the needling head can be configured for different needle board widths (support carrying the plurality of needles) and/or for different stripper widths, for example so as to be able to needle textile strips of a width comprised between 5 mm and 500 mm, preferably textile strips of a width comprised between 5 mm and 200 mm. The needle board and the stripper can also be removable from the needling head in order to adapt them to the geometry of the preform to be made and/or to the widths of needled textile strips.

Whatever the embodiment, the needling head, particularly the needles, forms an angle $\alpha$ (represented in FIG. 3) variable relative to an axis 270 perpendicular to the tangent plane 260 of the support tooling 250 during all or part of the deposition and needling of the textile strip, for example this angle is comprised between −85° and 85°, preferably between −30° and 30°. More generally, the needling head is adjustable along all directions about this perpendicular axis 270. This allows the textile strips to be needled in different orientations, for example diagonally or at an angle to transfer fibers in a certain orientation to confer some thermomechanical and/or abrasion resistance properties to the final part.

Whatever the embodiment, the needling head can be programmed to move and orient itself, thanks to the robotic arm, around the support tooling to deposit and needle the textile strip. The program of displacement and orientation of the needling head thus comprises the points of passage and the angular orientation of the needling head around the support tooling.

The points of passage can be determined as a function of the positions of the Z fibers in the textile preform to be made, of its local radius of curvature and of a minimum distance to be met between the needling head and the support tooling or the preform to avoid damaging the preform. The angular orientation of the needling head can be determined for each point of passage as a function of the angular orientation of the Z fibers in the preform to be made.

In addition, in order to facilitate the programming of the needling head, and in the case of a support tooling in rotation on itself, the points of passage can be expressed in terms of distance between the needling head and the support tooling. To do so, it is possible to project the points of passage into a fixed reference plane relative to the support tooling, and thus to program the head according to the distance between the needling head and the support tooling.

Whatever the embodiment, it is also possible to drive the pressure of the stripper by a servo-control. Particularly, the stripper can apply a pressure on the strip so as to hold it in place when the needles come out.

Whatever the embodiment, it is also possible to drive the needling head by a servo-control as a function of the pressure of the stripper and/or as a function of the position of the stripper if it is floating and/or as a function of the position of the needles It is also possible to drive the position of the robot by a servo-control as a function of the pressure of the stripper and/or as a function of the position of the stripper if it is floating and/or as a function of the position of the needles.

It is also possible to drive the position of the support by a servo-control as a function of the pressure of the stripper and/or as a function of the position of the stripper if it is floating and/or as a function of the position of the needles.

FIG. 4 represents a flowchart of the method 400 for determining a program of displacement and orientation of a needling head according to one embodiment of the invention, and FIGS. 5A, 5B, 5C and 5D represent the different steps of this same method. The method is thus described with reference to FIGS. 4, 5A, 5B, 5C and 5D.

The method 400 is a method for determining a program of displacement and orientation of a needling head 530 for making a textile preform 500 by needling a textile strip on a support tooling 505. This method 400 comprises determining 410 a set of triplets of coordinates (x, y, z), (x1, y1, z1), (x2, y2, z2), (x3, y3, z3) of the points of passage 520, 521, 522, 523 of the needling head 530. For reasons of clarity, only a few points are visible in the figures, however the number of points of passage is not limited to these four points. In addition, the position of these points visible in FIG. 5B does not mean that the point 520 (or the point 522) is firstly determined before the point 521 (or the point 523). Generally, the order of determination of the different points of passage of the head follows the unwinding and needling of the textile strip on the support tooling.

The points of passage 521, 522, 523 are determined as a function of the positions of the fibers along the X, Y, Z axes, particularly along the Z axis in the textile preform to be made 500, of the local geometry of the preform 500, for example its local radius of curvature, and of the minimum distance $d_{min}$. This minimum distance $d_{min}$ is a distance making it possible to avoid a collision between the needling head 530 and the preform 500 being made or the support tooling 505. The minimum distance $d_{min}$ is predetermined by the user. This step 410 is represented in FIG. 5B.

The number of points of passage 520, 521, 522, 523 may depend on the complexity of the preform to be made 500. For example, if the preform is of complex shape (for example a non-axisymmetric shape), the number of points passage will be generally greater than a preform of simple shape (for example an axisymmetric shape).

Then the method 400 comprises determining 420 the angular orientation of the needling head 530 for each point of passage 520, 521, 522, 523 determined in step 410 as a function of the angular orientation of the Z fibers in the textile preform to be made 500. This step 420 is represented in FIG. 5C. In this step 420, the angle α formed between the needling head 530 and the Z axis for the point of passage 520 and/or the angle β formed between the needling head 530 and the X axis for the point of passage 520 are determined for example. More particularly, in the example of determining the angle α, the angle α is formed between the Z axis and the orientation of the head, which corresponds to the orientation 560 of the Z fibers for this point of passage 520.

The method 400 can also comprise a step 409 of making a mesh 510 of the geometry of the textile preform to be made 500. The determination 410 of all the triplets of coordinates (x, y, z) of the points of passage is thus performed on this mesh 510. This step 409 is represented in FIG. 5A. This makes it possible to simplify the geometry of the preform 500 and to more easily determine the points of passage 520.

When the support tooling 505 rotates about an axis of rotation 580, the method 400 can also comprise a step 421 of projecting the points of passage 520 determined in step 410 into a reference plane 540 fixed or movable relative to the support tooling 505 and comprising the axis of rotation 580 of the support tooling 505. The reference plane 540 can for example be the plane (YZ) or the plane (XY) or the plane (A). This makes it possible to determine the polar coordinates (r, θ, z) of the points of passage 520. This step 421 is represented in FIG. 5D.

The method 400 can also comprise determining a local speed of displacement of the needling head 530 as a function of the content of Z fibers in the associated area of the preform to be made 500 as a function of a possible displacement of the support tooling 505. For example, if the support tooling 505 is rotating during the needling, according to the radius of curvature of the geometry of the preform to be made 500, it may be interesting to vary the speed of displacement of the needling head 530 between the points of passage 520 along this radius of curvature to best adapt the content of Z fibers.

FIG. 6 represents a flowchart of the method 600 for manufacturing a textile preform by needling according to one embodiment of the invention.

The method 600 first comprises determining 610 a program of displacement and orientation of a needling head according to the invention, therefore for example according to the method described above, then manufacturing 620 by needling the textile preform on a support tooling. The support tooling has the same shape as the inner surface of the preform to be made. The needling is carried out using a needling head programmed according to the program determined in step 601.

A needling system used for the manufacture is for example a system comprising:

- a needling head programmed according to the determined program;
- a robotic arm movable in several degrees of freedom, carrying the needling head and configured so as to move the needling head following trajectories and orientations predetermined in the displacement and orientation program;
- a textile strip feeding device mounted on the needling head and configured to deposit the textile strip on a support tooling and cut it, and
- a monitoring unit configured to control the robotic arm, the actuation of the needling head and the deposition of the textile strip according to the head displacement and orientation program.

The support tooling used to determine the program of displacement and orientation of the needling head and to manufacture the textile preform may have a non-axisymmetric and/or non-through shape. This allows making a preform with a non-axisymmetric and/or non-through shape, which can for example thus form an atmospheric re-entry thermal protection preform.

The support tooling can also rotate, in both directions about an axis of rotation, during the needling, in order to facilitate the displacements of the robotic arm. The monitoring unit can, in this case, drive the rotation of the support tooling. For example, it can control the axis of rotation and/or the speed of rotation of the support tooling.

The expression "comprised between . . . and . . . " must be understood as including the bounds.

The invention claimed is:

1. A needling system for making a textile preform comprising:

a needling head;

a robotic arm movable in several degrees of freedom, carrying the needling head and configured so as to move the needling head following the predetermined trajectories and orientations;

a textile strip feeding device, mounted on the needling head and configured to deposit the textile strip on a support and cut it, and a monitoring unit configured to control the robotic arm, the actuation of the needling head and the deposition of the textile strip according to a predefined program for making the textile preform.

2. The needling system according to claim 1, wherein the textile strip feeding device comprises a regulation system configured to adjust a tension of the textile strip when the textile strip is deposited on the support as a function of a given instruction, or as a function of one particular point of the trajectory.

3. The needling system according to claim 1, wherein the textile strip feeding device comprises a guide system for guiding the textile strip.

4. The needling system according to claim 3, wherein the guide system comprises diverting rollers adjustable according to at least one spherical three-dimensional reference frame.

5. The needling system according to claim 1, wherein the textile strip feeding device comprises a regulation system in lateral position.

6. A method for manufacturing a textile preform by needling implemented by the needling system according to claim 1 on a support tooling whose shape corresponds to that of the textile preform to be made, the method comprising the deposition and the needling of a textile strip on the support tooling.

7. The method according to claim 6, wherein the support tooling has a non-axisymmetric and/or non-through shape.

8. The method according to claim 6, wherein the textile strip is deposited and needled on the support tooling without trajectory limitation.

9. The method according to claim 6, wherein the needling head forms an angle comprised between −85° and 85° relative to the direction perpendicular to the tangent plane of the support tooling during all or part of the deposition and of the needling of the textile strip.

* * * * *